US008600282B2

(12) United States Patent
Hisakuni

(10) Patent No.: US 8,600,282 B2
(45) Date of Patent: Dec. 3, 2013

(54) IMAGE FORMING APPARATUS

(75) Inventor: Hisataka Hisakuni, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 384 days.

(21) Appl. No.: 12/639,875

(22) Filed: Dec. 16, 2009

(65) Prior Publication Data

US 2010/0150594 A1 Jun. 17, 2010

(30) Foreign Application Priority Data

Dec. 17, 2008 (JP) ..... 2008-321636

(51) Int. Cl.
*G03G 15/00* (2006.01)

(52) U.S. Cl.
USPC ..... 399/388; 399/18; 399/19; 399/20; 399/121

(58) Field of Classification Search
USPC ..... 399/388, 18–21
See application file for complete search history.

(56) References Cited

U.S. PATENT DOCUMENTS 5,787,326 A * 7/1998 Ogawa et al. ..... 399/124
2005/0084274 A1* 4/2005 Yoshida ..... 399/44
2005/0191066 A1* 9/2005 Yamazaki ..... 399/21
2005/0220488 A1* 10/2005 Fujita et al. ..... 399/124
2009/0304398 A1* 12/2009 Shimizu ..... 399/21
2010/0014883 A1* 1/2010 Thayer et al. ..... 399/71

FOREIGN PATENT DOCUMENTS

JP 2002-139931 A 5/2002
JP 2002-162833 6/2002
JP 2005-274764 10/2005
JP 2005-338351 A 12/2005

* cited by examiner

*Primary Examiner* — Matthew G Marini
*Assistant Examiner* — Allister Primo
(74) *Attorney, Agent, or Firm* — Canon USA Inc. IP Division

(57) ABSTRACT

The present invention provides an image forming apparatus including: an intermediate transfer member having an elastic layer, to which a toner image on an image bearing member is transferred at a primary transfer portion; a transfer device configured to transfer the toner image on the intermediate transfer member to a recording material at a secondary transfer portion; a cleaning unit configured to be in contact with the intermediate transfer member and clean the intermediate transfer member; and a detection device configured to detect the position of the recording material stopped in the image forming apparatus due to conveyance failure. In a returning operation including driving control of the intermediate transfer member performed after the stopped recording material has been removed, the driving control of the intermediate transfer member is performed according to the detection result of the detection device.

8 Claims, 10 Drawing Sheets

| FIG. 6A |
| --- |
| FIG. 6B |

IMAGE FORMING APPARATUS

BACKGROUND OF THE INVENTION

1. Field of the Invention

The present invention relates to image forming apparatuses employing an electrophotography process, such as electrostatic copiers and electrostatic printers.

2. Description of the Related Art

Some image forming apparatuses employing an electrophotography process are configured to form an image by transferring toner images of a plurality of colors formed on photosensitive drums to an intermediate transfer member so as to be superimposed on one another and then transferring the superimposed images to a recording material.

Japanese Patent Laid-Open No. 2002-162833 discloses a technique for forming an elastic layer on an intermediate transfer member. Because of this elastic layer, the surface of the intermediate transfer member conforms to a recording material having unevenness. Thus, toner images can be uniformly transferred regardless of the unevenness of the recording material.

In this configuration, the intermediate transfer member needs to be cleaned to remove residual toner after images are formed thereon so that it can be used repeatedly. Therefore, for example, an edge of a cleaning blade made of an elastic material, such as rubber, is brought into contact with the intermediate transfer member to clean the intermediate transfer member.

However, in the above-described configuration, although the intermediate transfer member having an elastic layer can provide a good image by being deformed, it may cause color misregistration during color image formation or cleaning failure when such deformation remains.

In general, elastic members have a viscoelastic behavior. If such elastic members are kept pressed with a predetermined strain for a long time, stress relaxation occurs. Once the stress relaxation occurs, the time to recover from the deformation increases after the strain is released.

An intermediate transfer member having an elastic layer has a problem in that, when a recording material, such as a sheet, stops at a transfer portion in a sandwiched state due to conveyance failure, it tends to be deformed in an edge area of the recording material. In particular, this problem is noticeable with a thick recording material, such as cardboard, because the edge portion of the recording material significantly deforms the elastic intermediate transfer member.

When edge portions of a recording material in the conveying direction (side edges) are pressed against the intermediate transfer member for a long time, the intermediate transfer member is deformed at fixed positions in the longitudinal direction thereof (a direction perpendicular to the recording-material conveying direction). This may form a recess in the intermediate transfer member, which may cause local cleaning failure due to no pressure being applied at a cleaning portion.

Furthermore, when an edge portion of a recording material in the direction perpendicular to the conveying direction (a leading end or a trailing end) is pressed against the intermediate transfer member for a long time, a continuous recess extending in the longitudinal direction of the intermediate transfer member is formed. This may prevent a blade, serving as a cleaning member, from sufficiently conforming to the recess, causing cleaning failure. In addition, there may be a problem in that the cleaning blade is curled up when the edge of the cleaning blade in contact with the intermediate transfer member in the longitudinal direction is stuck in this recess.

When the blade is curled up, the cleaning blade cannot exhibit its cleaning performance, causing cleaning failure.

SUMMARY OF THE INVENTION

The present invention provides an image forming apparatus capable of preventing cleaning failure of a cleaning unit for cleaning an intermediate transfer member having an elastic layer, which occurs when conveyance failure of a recording material occurs.

The present invention also provides an image forming apparatus including: an image bearing member on which a toner image is formed; an intermediate transfer member having an elastic layer, to which the toner image on the image bearing member is transferred at a primary transfer portion; a transfer device constituting a secondary transfer portion that transfers the toner image on the intermediate transfer member to a recording material; a conveying device configured to convey the recording material; a cleaning unit configured to be in contact with the intermediate transfer member and clean the intermediate transfer member; a detection device configured to detect the position of the recording material when the recording material stops in the image forming apparatus during an image forming operation; and a controller configured to, in a returning operation including driving control of the intermediate transfer member performed after the stopped recording material has been removed, perform the driving control of the intermediate transfer member such that the driving time of the intermediate transfer member is longer when the detection device detects that the recording material exists at the secondary transfer portion than when the detection device detects that the recording material does not exist at the secondary transfer portion.

Further features of the present invention will become apparent from the following description of exemplary embodiments with reference to the attached drawings.

DESCRIPTION OF THE EMBODIMENTS

An example of an image forming apparatus of the present invention will be described. In the following description, unless otherwise specifically stated, within the principle of the present invention, various structures of the image forming apparatus can be replaced by other known structures that perform the same functions. That is, unless otherwise specifically stated, there is no intention to limit the present invention to the structures of the image forming apparatus according to the embodiments described below.

First Embodiment

Figure 1:
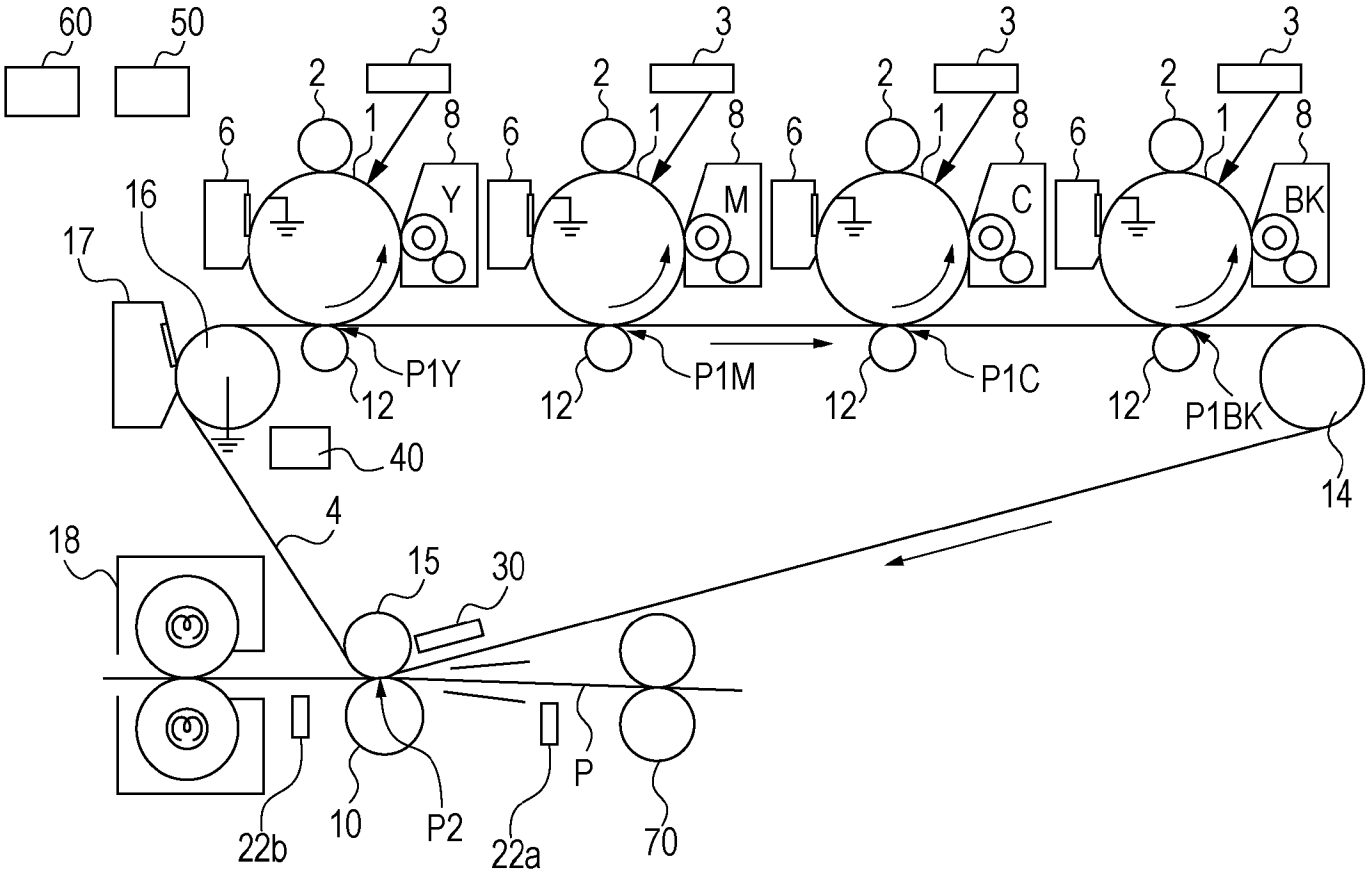
FIG. 1 is a schematic view showing the configuration of an image forming apparatus according to this embodiment.
Figure 2:
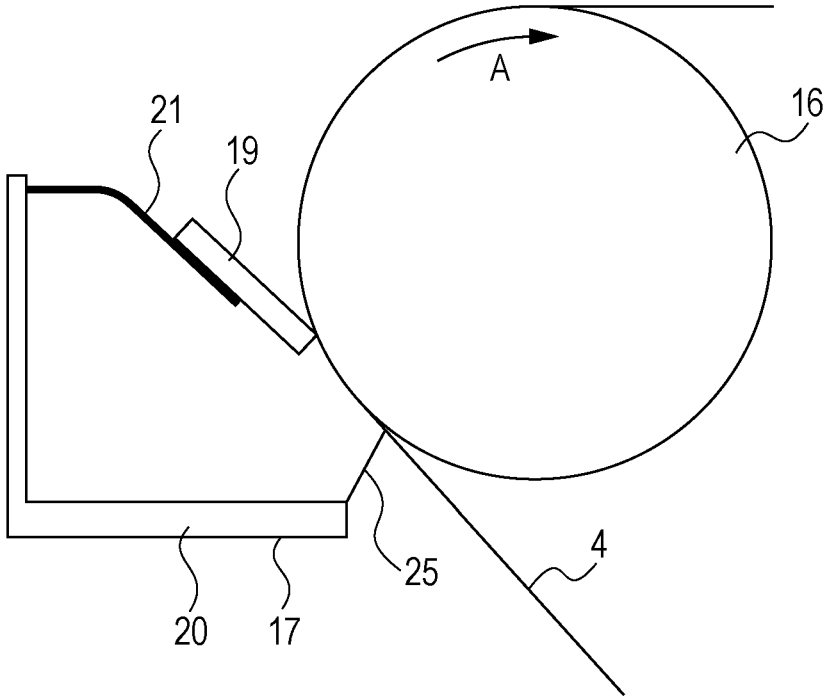
FIG. 2 is a side sectional view of a cleaning unit according to this embodiment.
Figure 3:
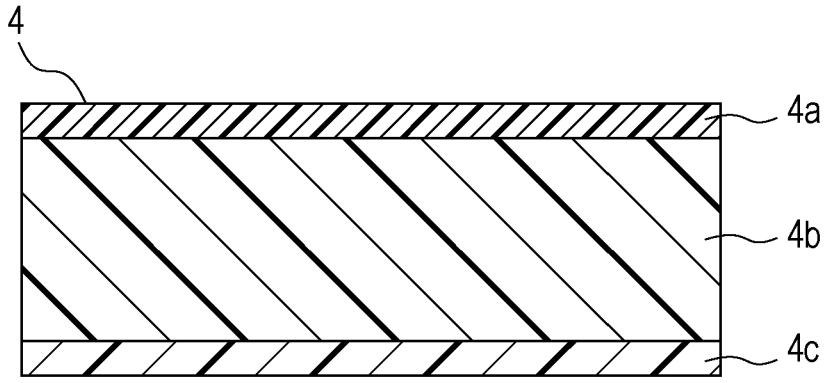
FIG. 3 is a side sectional view for showing a layer structure of the intermediate transfer member.
Figure 4:
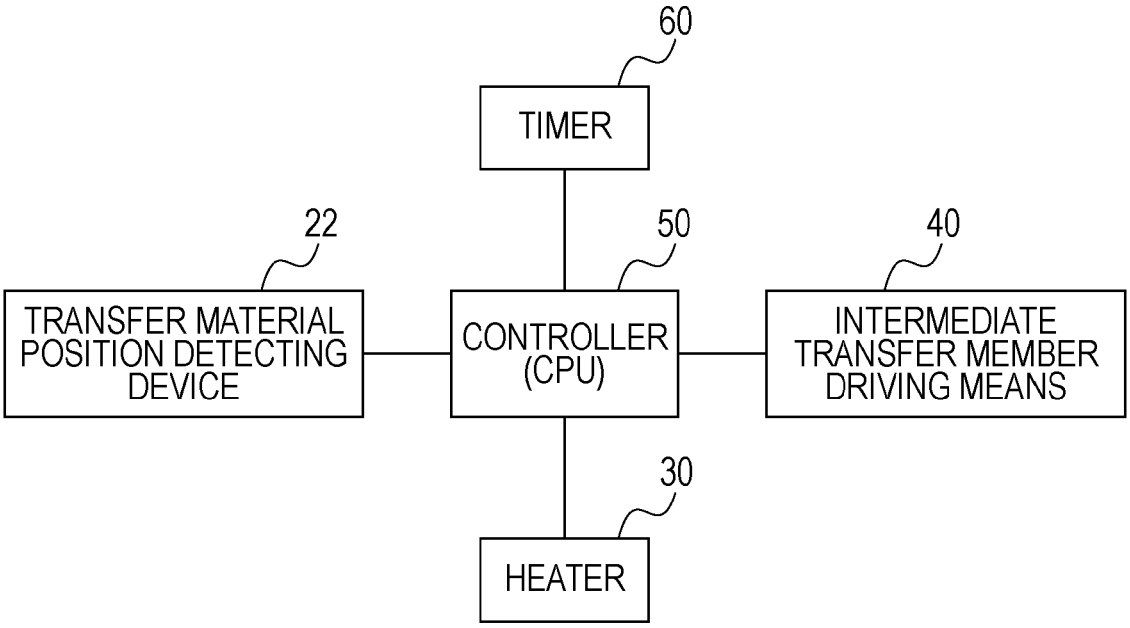
FIG. 4 is a block diagram of the present invention.

FIG. 1 is a schematic cross-sectional view of an image forming apparatus of the present invention, FIG. 2 is a side sectional view of a cleaning unit according to this embodiment, and FIG. 3 is a cross-sectional view showing a layer structure of an intermediate transfer member. FIG. 4 is a control block diagram of the present invention, and FIGS. 5A to 5D are diagrams showing a recording material stopping at a secondary transfer portion.

Image Forming Apparatus

The image forming apparatus in FIG. 1 is a copier employing an electrophotography method, which forms an image on a recording material in accordance with an image signal sent from a computer or the like (not shown). After photosensitive members 1, serving as image bearing members, are uniformly charged by chargers 2, exposure units 3 emit laser beams according to image signals. Electrostatic images are formed at portions on the photosensitive members 2 irradiated with the beams, and developing units 8 develop the electrostatic images with toner serving as a developer. Thus, toner images are formed. An intermediate transfer member 4 is pressed against the photosensitive members 1 at primary transfer portions P by primary transfer rollers 12. When a transfer voltage is applied to the primary transfer rollers 12, the toner images on the image bearing member are transferred to the intermediate transfer member 4. The residual toner on the photosensitive members 1, which was not transferred at the primary transfer portions P, is recovered by cleaning units 6.

The intermediate transfer member 4, which is formed as an endless belt, is looped around a driving roller 16 and driven rollers 14 and 15. By driving the driving roller 16 with a driving unit 40 (for example, a motor), driving control is performed.

The image forming apparatus according to this embodiment includes four photosensitive members 1 corresponding to four colors, namely, yellow (Y), magenta (M), cyan (C), and black (K). The toner images formed on these photosensitive members 1 are transferred so as to be superimposed on one another to the intermediate transfer member 4 at the respective primary transfer portions (P1Y, P1M, P1C, and P1BK).

The toner images of four colors on the intermediate transfer member 4 are transferred to a recording material, which is conveyed to a secondary transfer portion P2 by a conveying roller pair 70 (a conveying device), by applying a transfer bias voltage to a secondary transfer roller (a transfer device) 10. The toner images transferred to the recording material are fixed by being heated and pressed by a fixing unit 18. After the secondary transfer, the residual toner on the intermediate transfer member 4 is removed by an intermediate-transfer-member cleaning unit 17. This cleaning unit 17 will be described in detail below.

A heater 30 for heating the vicinity of the secondary transfer portion P2 is provided near the secondary transfer portion P2. The heater 30 may be a typical heater that heats by being supplied with electric power, and the temperature thereof is controlled by an output of a temperature detection sensor that detects the temperature near the secondary transfer portion P2.

Furthermore, a timer 60 that measures the time during which the recording material has stopped in the image forming apparatus when a recording material jam occurs is provided.

In addition, a controller (CPU) 50 that receives information from the image forming apparatus and controls the operation of the image forming apparatus is provided.

FIG. 4 is a block diagram showing the relationship of these components. The operations of the timer 60 and the heater 30 will be described in detail below.

An "image forming operation" means a series of operations including: forming toner images by performing charging, exposure, and developing while rotating the photosensitive members 1; transferring the toner images to the revolving intermediate transfer member 4; and transferring the toner images from the intermediate transfer member 4 to a recording material.

In this embodiment, OPC photosensitive members having a charge generating layer using titanyl phthalocyanine pigments and a charge transport layer using bisphenol Z-type polycarbonate as a binder are used as the photosensitive members 1. However, A-Si photosensitive members or Se photosensitive members may also be used.

The toner used in this embodiment is produced by a suspension polymerization method and includes ester wax in the core, styrene-butylacrylate in a resin layer, and styrene polyester in a surface layer. The toner is produced such that a shape factor SF-1 is 100≤SF-1≤140, and a shape factor SF-2 is 100≤SF-2≤120.

The composition of the polymerized toner and resin magnetic carrier produced by a polymerization method is used as a two component developer in the developing units 8.

The process speed (the moving speed of the photosensitive members 1 and intermediate transfer member 4) of the image forming apparatus according to this embodiment is set to 200 mm/s. The diameter of the photosensitive members 1 is 30 mm, and the perimeter of the intermediate transfer member 4 (the length in the belt conveying direction) is 300 mm.

Cleaning Unit

FIG. 2 shows the cleaning unit 17 for cleaning the intermediate transfer member 4. The cleaning unit 17 includes a casing (container) 20 having an opening at the intermediate transfer member 4. A cleaning blade 19 made of urethane rubber or the like is attached to the opening with a support member 21. The cleaning blade 19, serving as a cleaning member and being in contact with the intermediate transfer member 4 at an edge, scrapes residual toner on the intermediate transfer member 4 off and recovers the toner into the container 20. A sheet-like member 25 attached below the opening in the casing 20 allows the scraped toner to fall into the casing 20 and prevents the toner from flowing back to the intermediate transfer member 4.

Herein, the cleaning blade 19 is disposed such that it is in contact with the intermediate transfer member 4 at a pressure per unit length in the longitudinal direction of the cleaning blade 19 (the direction perpendicular to the traveling direction of the intermediate transfer member 4) of 250 mN/cm.

A method of fabricating the intermediate transfer member 4 having the elastic layer according to this embodiment is as follows.

An elastic layer 4*b* is formed on a surface of a polyimide belt member (base layer) 4*c* formed in advance.

The elastic layer 4*b* is formed as follows. A prepolymer composed of ethylene butylene adipate polyester polyol and 4,4'-diphenylmethane diisocyanate is prepared. Then, a cross-linking agent containing a triethylenediamine catalyst formed by mixing 1,4-butanediol and trimethylolpropane is mixed with the prepolymer to form a polyurethane layer having a desired elastic modulus. Note that by increasing or decreasing the amount of the cross-linking agent to be mixed with the prepolymer, the elastic modulus of the urethane can be changed.

Furthermore, a surface layer 4*a* made of fluororesin is provided on the elastic layer 4*b*. This serves as a protection layer against damages to the intermediate transfer member 4, as well as a releasing layer that allows the toner to be properly transferred to the recording material.

Although the belt of the intermediate transfer member 4 according to this embodiment is made of urethane rubber, other elastomers capable of providing a hard layer in the surface layer may also be used.

The intermediate transfer member 4 is formed by a one-shot method in which the above-described ingredients are mixed at once and are poured into a mold or a cylindrical mold for centrifugal molding. Alternatively, it may be formed by a prepolymer method in which a prepolymer is made by allowing isocyanate and polyol to react with each other in advance, is mixed with a cross-linking agent, and is then poured into a mold or a cylindrical mold for centrifugal molding. Still alternatively, a semi-one-shot method may be used in which a semi-prepolymer made by allowing isocyanate and polyol to react with each other and a hardening agent made by adding polyol to a cross-linking agent are allowed to react with each other and are poured into a mold or a cylindrical mold for centrifugal molding.

In this embodiment, the base layer 4*c* has a hardness of 100° (JIS A) and a thickness of 70 μm. The elastic layer 4*b* has a hardness of 30° (JIS A) and a thickness of 225 μm. The surface layer 4*a* has a hardness of 100° (JIS A) and a thickness of 5 μm. However, the present invention is not limited to these values. For example, an appropriate range of the hardness of the elastic layer is from 20° to 50° when it used as the intermediate transfer member 4. When the hardness is less than 20°, the strength as a belt used by being stretched is insufficient. Furthermore, recovery after deformation is slow. When the hardness exceeds 50°, the ability to conform to the unevenness of the recording material surface is insufficient.

Normal Paper-Jam Returning Mode

Next, a returning mode (returning operation), which the image forming apparatus executes after a user removes a jammed sheet, will be described.

When a so-called paper jam, in which a recording material stops in the image forming apparatus due to conveyance failure, occurs, the image forming operation also stops. Thus, toner images remain on the stopped photosensitive members 1 or intermediate transfer member 4.

Therefore, after removing the jammed recording material and before restarting the image forming operation, a returning operation for removing residual toner on the surfaces of the photosensitive members 1 and intermediate transfer member 4 needs to be performed.

Accordingly, in this embodiment, the returning operation is performed in which the photosensitive members 1 are rotated without being charged and are cleaned by the cleaning units 6, and the intermediate transfer member 4 is allowed to revolve and is cleaned by the cleaning unit 17. Note that, when the photosensitive members 1 are rotated without being charged, exposure by the exposure units 3 and a developing operation by the developing units 8 are not performed.

In this embodiment, this returning operation is performed while the intermediate transfer member 4 having a larger perimeter than the photosensitive members 1 makes at least one revolution. This returning operation is referred to as a normal paper-jam returning mode. The execution time of the normal returning mode is 1.5 s because the perimeter is 300 mm and the process speed is 200 mm/s.

Transfer Portion Paper Jam Detection Device

A method for detecting the occurrence of a paper jam at the secondary transfer portion P2 is as follows. As shown in FIG. 1, a sheet detection sensor 22*a* (detection device) is disposed at a first position on the upstream side of the secondary transfer portion P2 in the recording-material conveying direction, and a sheet detection sensor 22*b* (detection device) is disposed at a second position on the downstream side of the secondary transfer portion P2 in the recording-material conveying direction. When a recording material stops in the image forming apparatus due to conveyance failure, the position of the recording material can be detected by these sensors.

The sheet detection sensors 22*a* and 22*b* have a sensor flag and a photo-interrupter. The presence of a sheet rotates the sensor flag, which blocks the photo-interrupter. Thus, these sensors 22*a* and 22*b* can detect the presence/absence of the sheet.

As a method for determining whether or not a recording material is jammed in the image forming apparatus, the following method may be used. For example, if the sheet detection sensors disposed in the image forming apparatus cannot detect passing of the recording material within a predetermined period of time after the recording material starts to be conveyed from a sheet feed cassette, then it is determined that the recording material stops due to conveyance failure. Of course, there is no need to limit to this method.

Next, referring to FIGS. 5A to 5D, a method for detecting the position of a paper jam at the secondary transfer portion P2 will be described.

Figure 5A:
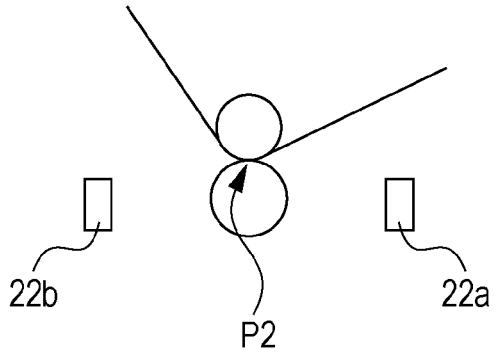
FIGS. 5A to 5D are diagrams showing a recording material stopping at a secondary transfer portion.

FIG. 5A shows a state in which a paper jam occurs in the image forming apparatus and the sheet does not exist at the pre-transfer sheet detection sensor 22*a* or at the post-transfer sheet detection sensor 22*b*. In this case, the sheet is not sandwiched at the secondary transfer portion P2 but exists at another portion.

Figure 5B:
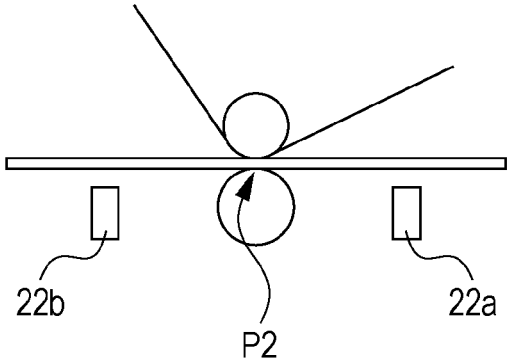

FIG. 5B shows a state in which the sheet exists at both the pre-transfer sheet detection sensor 22*a* and the post-transfer sheet detection sensor 22*b*. In this case, although the sheet is sandwiched at the transfer portion P2, neither the leading end nor trailing end of the sheet exists at the transfer portion P2.

Figure 5C:
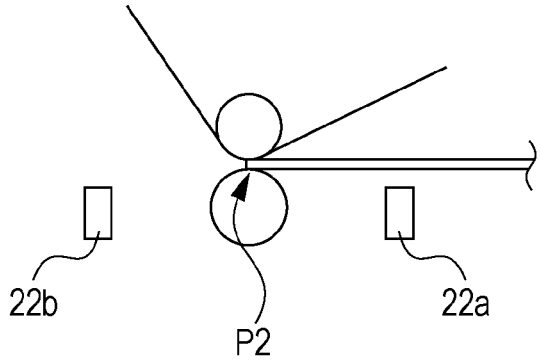

FIG. 5C shows a state in which the sheet exists at the pre-transfer sheet detection sensor 22*a* but not at the post-transfer sheet detection sensor 22*b*, and the leading end of the sheet may be sandwiched at the transfer portion P2. Thus, in this case, the leading end of the sheet may produce a deformation (recess) in the longitudinal direction of the intermediate transfer member 4 (the direction perpendicular to the recording-material conveying direction).

Figure 5D:
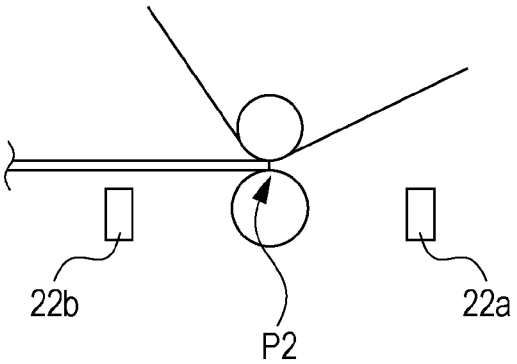

FIG. 5D shows a state in which the sheet exists not at the pre-transfer sheet detection sensor 22*a* but at the post-transfer sheet detection sensor 22*b*, and the trailing end of the sheet may be sandwiched at the transfer portion P2. Thus, in this case, the trailing end of the sheet may produce a deformation (recess) in the longitudinal direction of the intermediate transfer member 4 (the direction perpendicular to the recording-material conveying direction).

Deformation Relaxation Modes

As has been described above, the extent of deformation of the intermediate transfer member 4 depends on the position where the recording material stops in the image forming apparatus. In particular, when the leading end or the trailing end is sandwiched at the secondary transfer portion P2, the deformation is significant. Therefore, it is desirable that an operation including driving control of the intermediate transfer member 4 be performed in the returning operation executed after removal of the recording material to relax the deformation.

In this embodiment, by performing driving control of the intermediate transfer member 4 in accordance with the detection result of the detection device 22 for detecting the position where the recording material stops, an appropriate deformation relaxation mode is executed. Note that this deformation relaxation mode is included in the returning operation.

Figures 6, 6A:
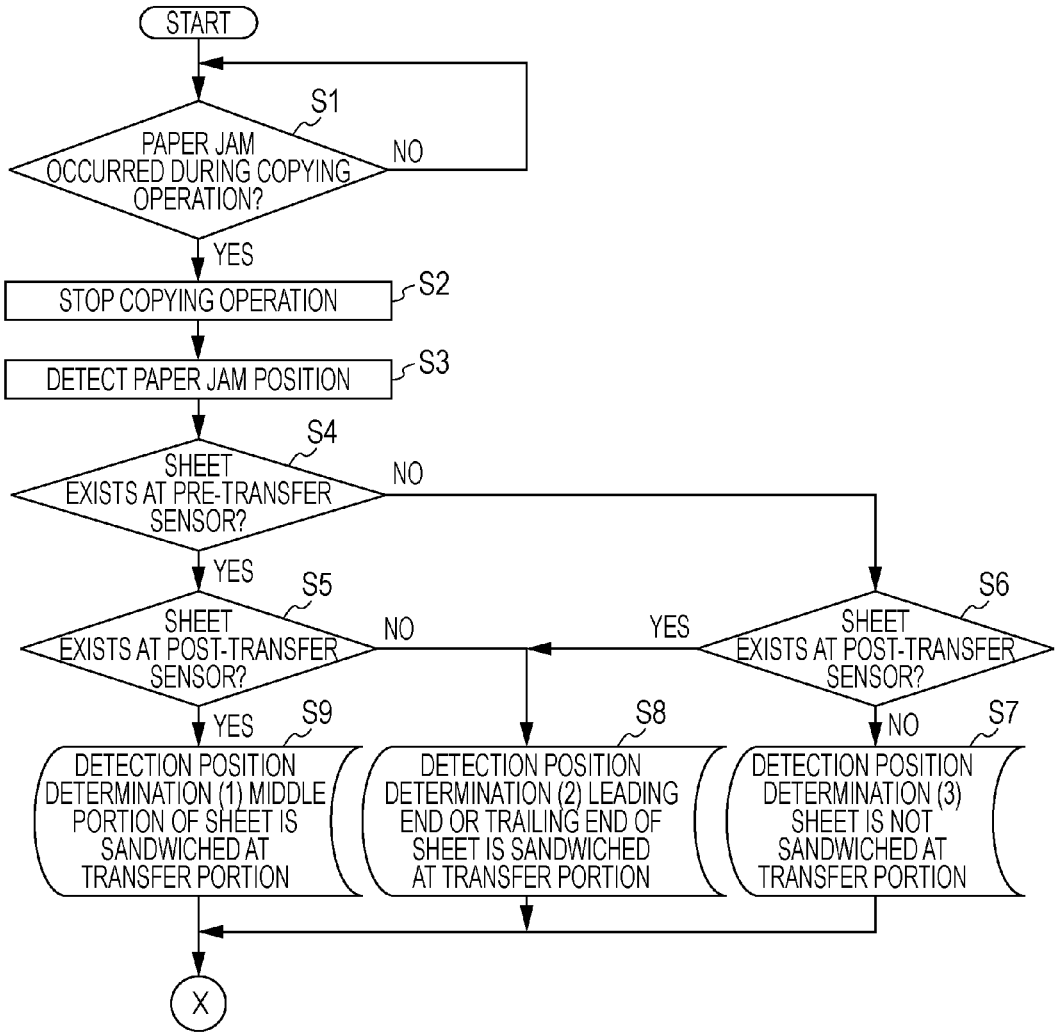
FIG. 6 is a flowchart of a first embodiment.
Figure 6B:
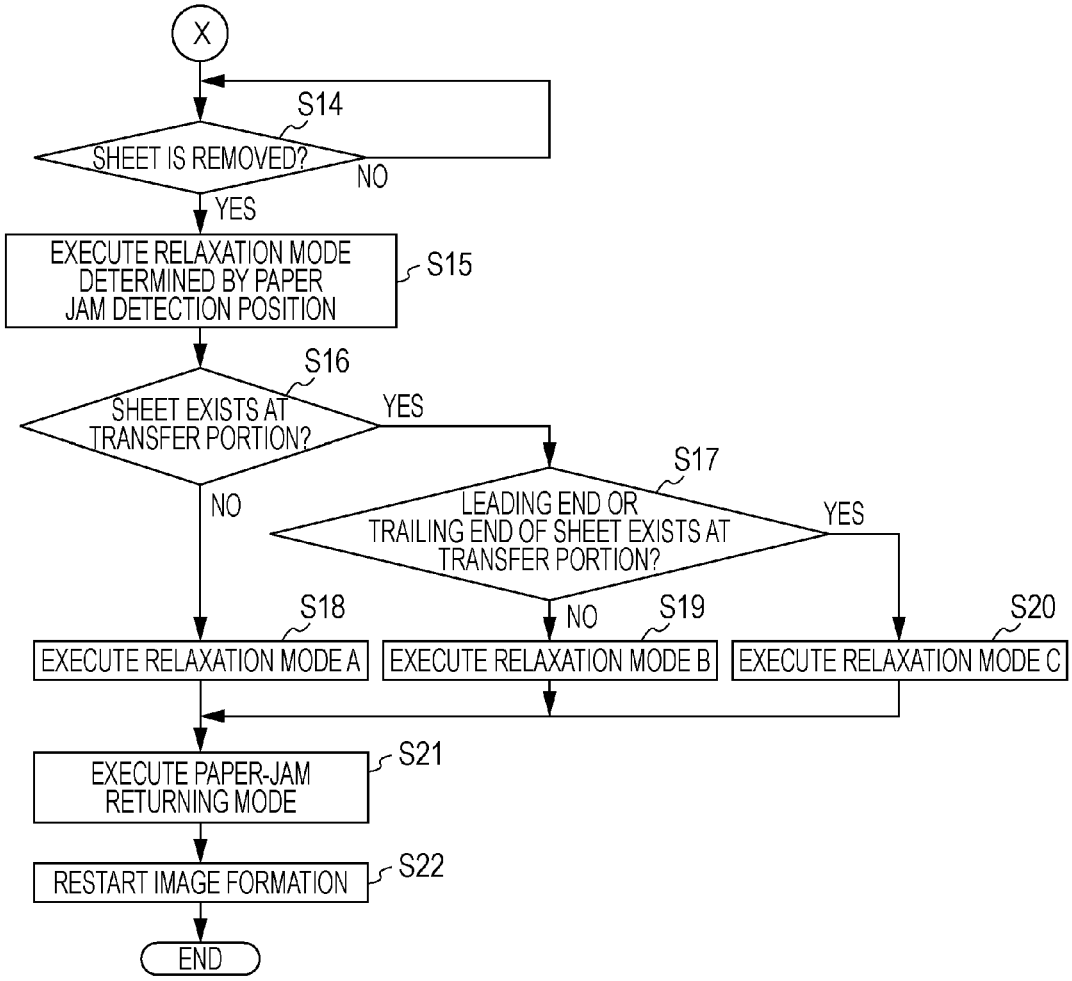

Referring to a flowchart in FIG. 6, deformation returning modes corresponding to respective paper jam conditions will be described below.

Whether or not a paper jam has occurred during a copying operation (during an image forming operation) is determined (step S1).

If a paper jam has occurred, the copying operation is stopped (step S2).

Then, the position of the stopped recording material is detected by the detection device 22 (step S3). In this detection, using the results of detecting the recording material by the pre-transfer sensor 22*a* and the post-transfer sensor 22*b*, the position of the recording material is determined (steps S4, S5, and S6).

When the recording material is detected by both the pre-transfer sensor 22*a* and the post-transfer sensor 22*b*, it is determined that a middle portion of the sheet (a portion except the leading end and the trailing end) is sandwiched at the secondary transfer portion P2 (step S7).

When only one of the pre-transfer sensor 22*a* and the post-transfer sensor 22*b* detects the recording material, it is determined that the leading end or trailing end of the sheet may be sandwiched at the secondary transfer portion P2 (step S8).

When neither the pre-transfer sensor 22*a* nor the post-transfer sensor 22*b* detects the recording material, it is determined that the recording material is not sandwiched at the secondary transfer portion P2, that is, the recording material stops at a position other than the secondary transfer portion P2 (step S9).

Then, whether or not a user has removed the jammed recording material is determined (step S14).

When it is determined that the sheet has been removed, a relaxation mode corresponding to the position of the recording material, determined in the foregoing step, is executed (steps S16, S17, S18, S19, and S20).

Three relaxation modes will be described below.

Relaxation Mode A (Steps S18 and S21)

When the sheet is not sandwiched at the transfer portion, the sheet remains at another portion. Because the intermediate transfer member 4 is not deformed by the sheet, the above-described normal paper-jam returning mode is performed. Thus, in this embodiment, no operation is performed at step S18, and only the normal paper-jam returning mode is executed at step S21. Therefore, the execution time of the returning operation when the relaxation mode A is selected is 1.5 s.

Relaxation Mode B (Steps S19 and S21)

When, although the sheet is sandwiched at the transfer portion, one of the leading end and trailing end of the sheet does not exist at the transfer portion, deformation occurs only at a portion corresponding to the sheet end portion in the longitudinal direction of the transfer belt.

In this case, when the intermediate transfer member 4 passes the cleaning member, the pressure decreases at the deformed portion, which is only a portion in the longitudinal direction, of the intermediate transfer member 4. To relax this deformation, the intermediate transfer member 4 is allowed to make 10 idling revolutions. The term "idling revolution" means, similarly to the normal paper-jam returning mode, an operation to allow the photosensitive members 1 and the intermediate transfer member 4 to make revolutions without performing operations such as charging.

In this embodiment, the execution time of the relaxation mode B is 15 s. After the relaxation mode B is executed, the normal paper-jam returning mode is performed for 1.5 s. Accordingly, the time for returning operation when the relaxation mode B is selected is 16.5 s. That is, the driving time of the intermediate transfer member 4 associated with the returning operation is 16.5 s.

Thus, the driving time of the intermediate transfer member 4 is longer in the relaxation mode B than the relaxation mode A.

Note that the idling revolution operation may be determined according to the material and the setting of stretching of the intermediate transfer member 4, as long as the deformation of the intermediate transfer member 4 is removed.

Relaxation Mode C (Steps S20 and S21)

When it is determined that the leading end or trailing end of the sheet is sandwiched at the transfer portion, the intermediate transfer member 4 may be deformed in the longitudinal direction.

In this case, because the intermediate transfer member 4 is uniformly deformed in a direction perpendicular to the traveling direction thereof, a step portion is formed at the cleaning portion. When the intermediate transfer member 4 deformed in this manner is allowed to revolve, if the deformation is large, the cleaning blade 19 may be curled up. Even if the deformation is small, cleaning failure may occur due to an impact of the edge of the cleaning blade dropping into the recess. Thus, the deformation caused by the leading end or trailing end of the sheet most significantly affects the cleaning performance.

In this embodiment, the operation is stopped (the intermediate transfer member 4 is not driven) for a predetermined period of time (in this embodiment, two minutes) after the image forming apparatus is recovered from a paper jam state, and then, the normal paper-jam returning mode begins. This accelerates relaxation of the deformation in the longitudinal direction of the intermediate transfer member 4 caused by the sheet edge due to the application of pressure at the secondary transfer portion P2.

In this embodiment, the execution time of the returning operation when the relaxation mode C is selected is 121.5 s.

After the above-described relaxation mode is executed (after the returning operation is executed), the image forming operation is started (step S22).

As has been described, in this embodiment, it is controlled such that the time for the returning operation is longer when the recording material stops at the secondary transfer portion P2 than when the recording material stops at a position other than the secondary transfer portion P2.

Furthermore, when only one of the pre-transfer sensor 22*a* and the post-transfer sensor 22*b* detects the presence of the recording material, the leading end or trailing end of the recording material may be located at the transfer portion. Therefore, it is controlled such that the intermediate transfer member 4 is driven after the intermediate transfer member 4 has been stopped for a predetermined period of time.

Second Embodiment

In this embodiment, in addition to the first embodiment, a timer 60 for measuring the time during which a recording material has stopped in the image forming apparatus due to conveyance failure is provided. When the leading end or trailing end of the recording material may be sandwiched at the secondary transfer portion P2 and the time measured by the timer 60 is equal to or larger than a first reference time, a relaxation mode D is performed. In the relaxation mode D, the intermediate transfer member 4 is first driven at a first speed and then is driven at a second speed that is higher than the first speed.

When the leading end or trailing end of the sheet is sandwiched at the transfer portion for the first reference time or more (in this embodiment, 10 minutes or more), stress relaxation progresses at the deformation. Thus, pressing by the secondary transfer portion P2 cannot sufficiently relax the deformation. When the relaxation mode B according to the first embodiment is executed in this state, because the intermediate transfer member 4 starts to be driven while the recess is not removed, the edge of the blade drops into the recess, which may result in curling up of the blade or cleaning failure.

Thus, in this embodiment, the intermediate transfer member 4 is allowed to make 10 revolutions at a first speed, which is a low speed (in this embodiment, one-fourth (50 mm/s) a normal driving speed (second speed)) during an initial phase of driving in which curling up of the blade tends to occur. While the intermediate transfer member 4 is revolving at the first speed, the recess is removed, and curling up of the blade is less likely to occur. Then, the normal returning mode is executed at the second speed (200 mm/s), which is the normal speed (the speed during the image forming operation).

Figure 7:
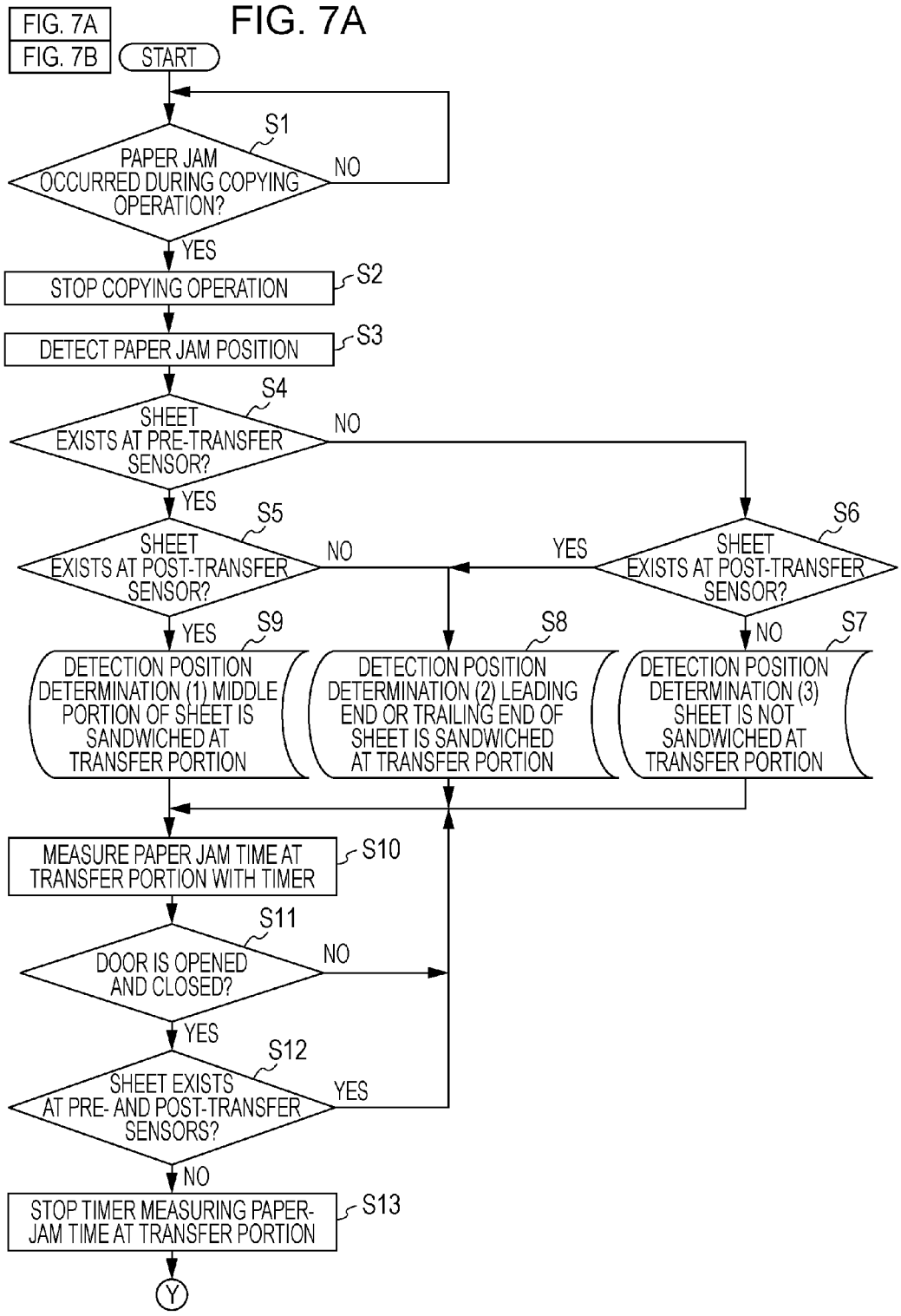
FIG. 7 is a flowchart of a second embodiment.
Figure 7B:
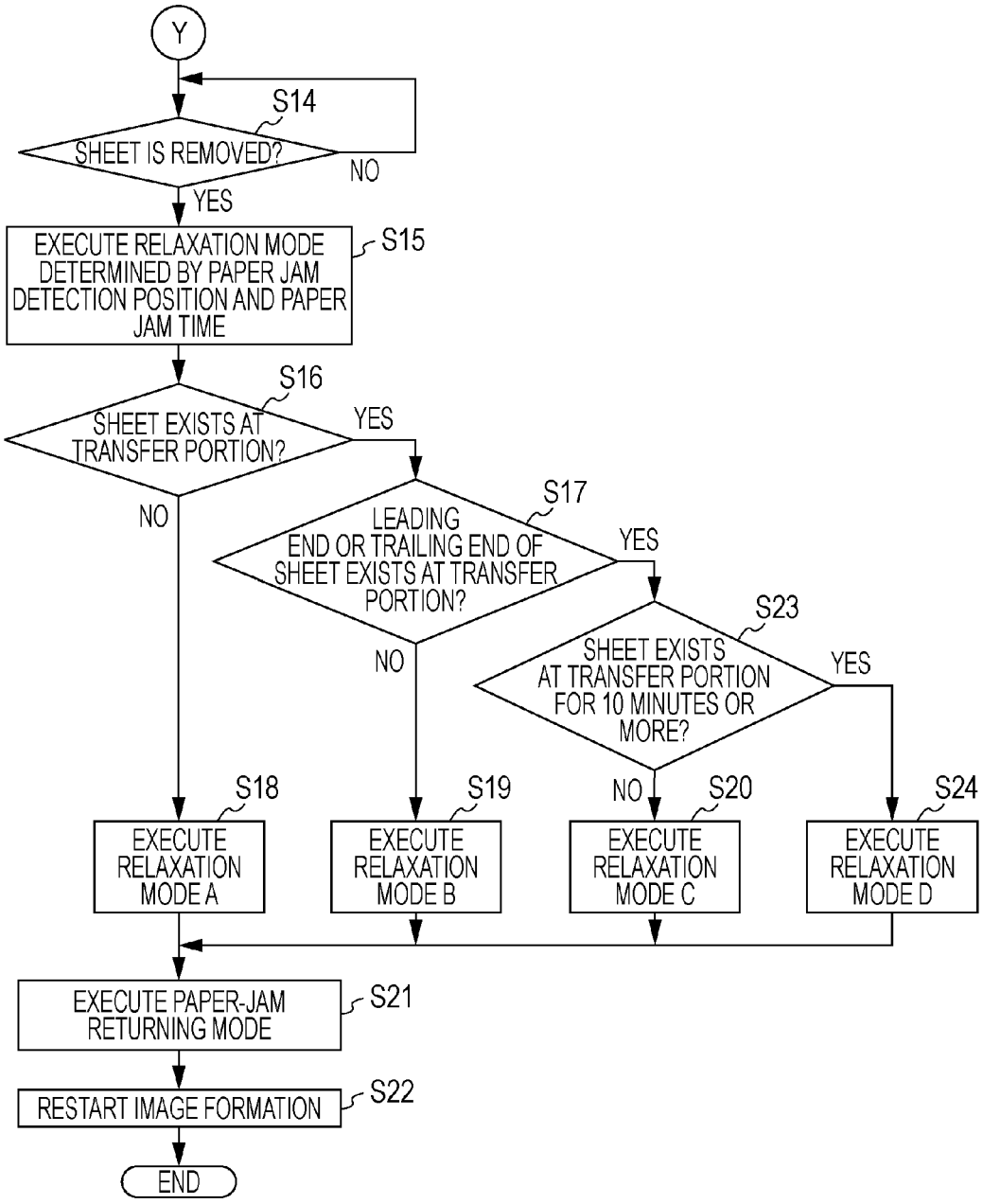

FIG. 7 is a flowchart showing the second embodiment of the present invention. The operations that are the same as those in the first embodiment are denoted by the same reference numerals and descriptions thereof will be omitted. A flow specific to this embodiment will be described below.

Relaxation Mode D

After a paper jam is detected, the timer 60 starts to measure the stop time (step S10).

Thereafter, a user opens a door to access the interior of the image forming apparatus and removes the jammed recording material. Then, after the door is closed, the presence/absence of the recording material is detected by the detection sensor, and whether or not the recording material has been removed is determined. If the recording material has been removed, the counter stops at this time (steps S10, S11, S12, S13, and S14). The stop of the counter tells the time during which the recording material has stopped in the image forming apparatus.

Then, when the leading end or trailing end of the recording material may be sandwiched at the secondary transfer portion P2 and the time measured by the timer 60 is equal to or larger than the first reference time (10 minutes or more), the above-described relaxation mode D is performed (steps S23 and S24).

Note that the execution time of the relaxation mode D according to this embodiment is 60 s.

After the relaxation mode D is completed, the normal returning mode is executed for 1.5 s (step S21).

Thus, in the second embodiment, the execution time of the returning operation when the relaxation mode D is selected is 61.5 s.

Third Embodiment

In this embodiment, in addition to the second embodiment, a heater 30 for heating the vicinity of the secondary transfer portion P2 is provided. When the leading end or trailing end of the recording material may be sandwiched at the secondary transfer portion P2 and the time measured by the timer 60 is equal to or larger than the second reference time, a relaxation mode E is performed. In the relaxation mode E, the vicinity of the secondary transfer portion P2 is heated by the heater 30, and, when the temperature in the vicinity of the secondary transfer portion P2 becomes equal to or higher than a predetermined value, the above-described relaxation mode C is executed. That is, after the temperature in the vicinity of the secondary transfer portion P2 becomes equal to or higher than a predetermined value, the intermediate transfer member 4 is stopped for a predetermined period of time, and then, the intermediate transfer member 4 starts to be driven.

When the leading end or trailing end of the sheet is sandwiched at the transfer portion for a second reference time (in this embodiment, an hour) or more, stress relaxation at the deformation progresses further. Thus, it is difficult to recover from the deformation with the above-described method.

Then, in the third embodiment, by heating the deformed portion (the vicinity of the secondary transfer portion P2) to a predetermined temperature or more (30° C. or more) with the heater 30 while the intermediate transfer member 4 is stopped, recovery from the deformation is accelerated. When the intermediate transfer member 4 is heated to a temperature at which recovery from the deformation tends to occur, the intermediate transfer member 4 is stopped for an additional period of time (2 minutes). This can further accelerate recovery from the deformation.

Figure 8:
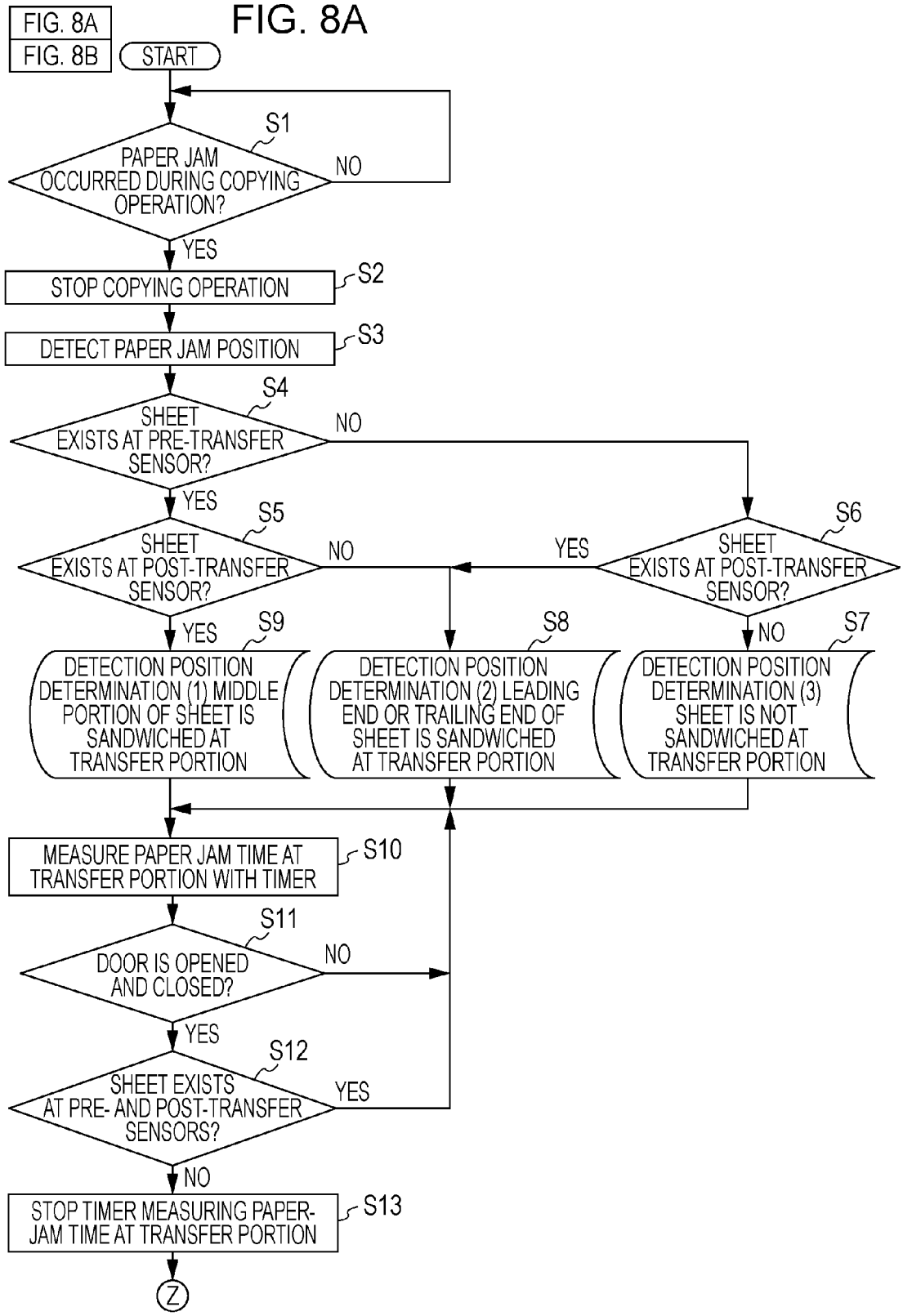
FIG. 8 is a flowchart of a third embodiment.
Figure 8B:
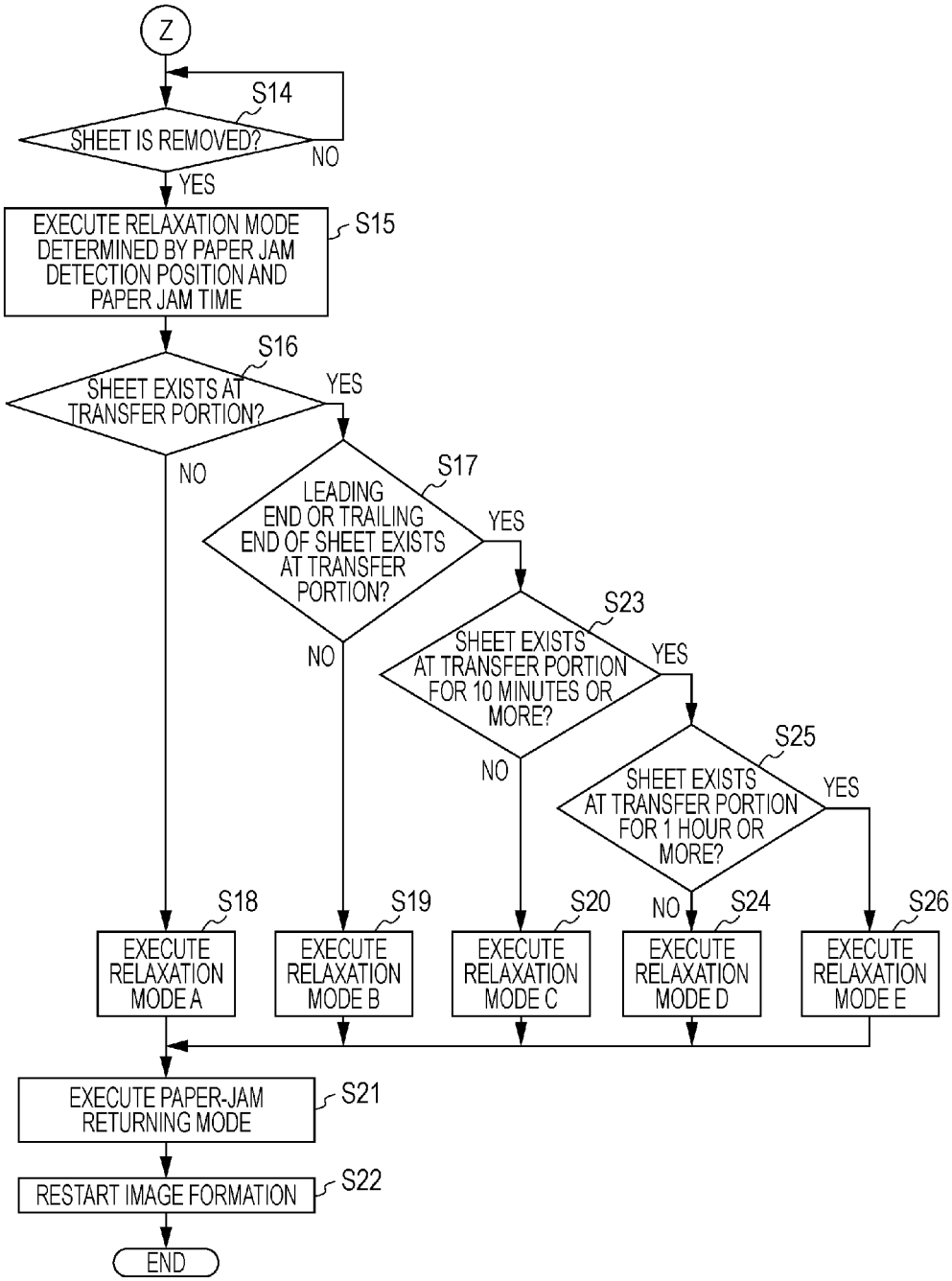

FIG. 8 is a flowchart showing the third embodiment of the present invention. The operations that are the same as those in the second embodiment are denoted by the same reference numerals and descriptions thereof will be omitted. A flow specific to this embodiment will be described below.

Relaxation Mode E

When the leading end or trailing end of the recording material may be sandwiched at the secondary transfer portion P2 and the time measured by the timer 60 is equal to or larger than the second reference time (an hour) or more, the above-described relaxation mode E is performed (steps S25 and S26).

Although the heater 30 is disposed near the secondary transfer portion P2 in this embodiment, the same effect can be obtained by using a heat source, such as the fixing unit, in the image forming apparatus.

As has been described above, according to the present invention, in an image forming apparatus having a cleaning unit that is in contact with an intermediate transfer member having an elastic layer and cleans the intermediate transfer member, cleaning failure occurring due to conveyance failure of a recording material can be prevented.

While the present invention has been described with reference to exemplary embodiments, it is to be understood that the invention is not limited to the disclosed exemplary embodiments. The scope of the following claims is to be accorded the broadest interpretation so as to encompass all modifications and equivalent structures and functions.

This application claims the benefit of Japanese Patent Application No. 2008-321636 filed Dec. 17, 2008, which is hereby incorporated by reference herein in its entirety.

What is claimed is:

1. An image forming apparatus comprising:

an image bearing member on which a toner image is formed;

a rotatable intermediate transfer member having an elastic layer, to which the toner image on the image bearing member is transferred at a primary transfer nip;

a transfer member configured to come into contact with the intermediate transfer member so as to form a secondary transfer nip, and transfer the toner image on the intermediate transfer member to a recording material at the secondary transfer nip;

a conveying device configured to convey the recording material to the secondary transfer nip;

a cleaning member configured to be in contact with the intermediate transfer member and clean the intermediate transfer member;

a detection device configured to detect the recording material on a pass of the secondary transfer nip;

a driving member configured to drive the intermediate transfer member; and a controller configured to, decide according to the output of the detection device whether the recording material exists or not at the secondary transfer nip when the recording material stops in the image forming apparatus during an image forming operation, and in a recovery operation, drive the driving member after the stopped recording material has been removed such that a driving time of the driving member is longer in a case that the controller decides that the recording material existed at the secondary transfer nip than in a case that the controller decides that the recording material did not exist at the secondary transfer nip.

2. The image forming apparatus according to claim 1, wherein the detection device is configured to comprise, a first sensor that is able to detect the recording material at a first position on an upstream side of the secondary transfer nip in a recording material conveying direction, and a second sensor that is able to detect the recording material at a second position on a downstream side of the secondary transfer nip in the recording material conveying direction, and wherein the controller decides according to the outputs of the first and second sensors whether the recording material exists both at the first and second positions or does not exist at the first or the second position when the recording material stops in the image forming apparatus during an image forming operation, and drives the driving member such that the driving time of the driving member in the recovery operation is longer in a case that the controller decides that the recording material existed both at the first and second positions than in a case that the controller decides that the recording material did not exist at the first or the second position.

3. The image forming apparatus according to claim 2, wherein the controller decides according to the output of the first and second sensors whether the recording material exists only at one of the first and second positions or not when the recording material stops in the image forming apparatus during an image forming operation, drives the driving member such that, in a case that the controller decides that the recording material existed only at one of the first and second positions, in the recovery operation performed after the stopped recording material has been removed, the driving member is driven after the driving member has been stopped for a predetermined time.

4. The image forming apparatus according to claim 3, further comprising a timer configured to measure the time, wherein the controller decides according to the output of the timer whether the time after the recording material has been stopped in the image forming apparatus during an image forming operation and until the recording material has been removed is equal to or larger than a reference time or not, and in a case that the controller, decides that the recording material existed only at one of the first and second positions and the time was equal to or larger than a first reference time, in the recovery operation performed after the stopped recording material has been removed, the controller drives the driving member at a first speed and then drives the driving member at a second speed that is higher than the first speed.

5. The image forming apparatus according to claim 4, wherein the second speed is a speed during the image forming operation.

6. The image forming apparatus according to claim 4, further comprising a heater configured to heat the vicinity of the secondary transfer nip, wherein in a case where the controller decides that the recording material existed only at one of the first and second positions and the time was equal to or larger than a second reference time that is longer than the first reference time, the controller starts driving the driving member after heating the heater.

7. An image forming apparatus comprising:

an image bearing member on which a toner image is formed;

a rotatable intermediate transfer member having an elastic layer, to which the toner image on the image bearing member is transferred at a primary transfer nip;

a transfer member configured to come into contact with the intermediate transfer member so as to form a secondary transfer nip, and transfer the toner image on the intermediate transfer member to a recording material at the secondary transfer nip;

a conveying device configured to convey the recording material to the secondary transfer nip;

a cleaning member configured to be in contact with the intermediate transfer member and clean the intermediate transfer member;

a detection device configured to detect the recording material on a pass of the secondary transfer nip;

a driving member configured to drive the intermediate transfer member; and a controller configured to, decide according to the output of the detection device whether the recording material exists or not at the secondary transfer nip when the recording material stops in the image forming apparatus during an image forming operation, and in a recovery operation, drive the driving member after the stopped recording material has been removed, such that the driving time of the driving member is changed according to the output of the detection device when the recording material stops in the image forming apparatus during an image forming operation.

8. An image forming apparatus comprising:

an image bearing member on which a toner image is formed;

a rotatable intermediate transfer member having an elastic layer, to which the toner image on the image bearing member is transferred at a primary transfer nip;

a transfer member configured to come into contact with the intermediate transfer member so as to form a secondary transfer nip, and transfer the toner image on the intermediate transfer member to a recording material at the secondary transfer nip;

a conveying device configured to convey the recording material to the secondary transfer nip;

a cleaning member configured to be in contact with the intermediate transfer member and clean the intermediate transfer member;

a detection device configured to detect the position of the recording material on a pass of the secondary transfer nip;

a driving member configured to drive the intermediate transfer member; and a controller configured to, decide according to the output of the detection device whether the recording material exists or not at the secondary transfer nip when the recording material stops in the image forming apparatus during an image forming operation, and in a recovery operation, drive the driving after the stopped recording material has been removed, such that the driving member is driven after the driving member has been stopped for a predetermined time, which is changed according to the output of the detection device when the recording material stops in the image forming apparatus during an image forming operation.

* * * * *